US005668531A

United States Patent [19]

Sukegawa et al.

[11] Patent Number: 5,668,531

[45] Date of Patent: Sep. 16, 1997

[54] SYNCHRONIZED ALARM HOLDING SYSTEM

[75] Inventors: Kiyoshi Sukegawa; Kunio Takada, both of Kawasaki, Japan

[73] Assignee: Fujitsu Limited, Kanagawa, Japan

[21] Appl. No.: 303,449

[22] Filed: Sep. 9, 1994

[30] Foreign Application Priority Data

Mar. 16, 1994 [JP] Japan ..... 6-046195

[51] Int. Cl.[6] ..... G08B 29/00

[52] U.S. Cl. ..... 340/506; 340/512; 340/517; 340/825.2; 340/825.14; 340/825.57; 340/522

[58] Field of Search ..... 340/506, 512, 340/517, 522, 527, 825.2, 825.14, 825.57, 825.61

[56] References Cited

U.S. PATENT DOCUMENTS 4,581,606 4/1986 Mallory ..... 340/506
5,384,563 1/1995 Massey ..... 340/825.14

FOREIGN PATENT DOCUMENTS 2149543 6/1985 United Kingdom .

*Primary Examiner*—Jeffery Hofsass
*Assistant Examiner*—Daryl C. Pope
*Attorney, Agent, or Firm*—Helfgott & Karas, P.C.

[57] ABSTRACT

In a system where the same alarm is held and displayed in different apparatuses, alarm information held in either an alarm detection apparatus or an alarm processing apparatus for a predetermined time is subjected to synchronization with respect to transmission (holding), the alarm information being displayed in a display/transfer part.

17 Claims, 14 Drawing Sheets

SYNCHRONIZED ALARM HOLDING SYSTEM

BACKGROUND OF THE INVENTION

The present invention relates to a synchronized alarm holding system, and more particularly to a synchronized alarm holding system wherein, when the same alarm is held and processed in different apparatuses, the difference between alarm processes in the apparatuses is eliminated, by synchronizing alarm processes in the apparatuses by means of a holding process part.

Recently, there has been a demand for a protection method wherein different apparatuses have the same displayed/held alarm state, when the display and output of the same alarm are held in different apparatuses. In actuality, when an alarm detection apparatus and an alarm processing apparatus are not embodied by the same apparatus, different apparatuses may have different displayed states and different held output states concerning the same alarm. Therefore, there is a need to realize a system wherein the displayed alarm states and the held alarm output states of different apparatuses are the same even when the alarm detection apparatus and the alarm processing apparatus are not embodied by the same apparatus.

An alarm holding system is a system whereby an occurrence of a failure in a processing apparatus or the like is indicated by lighting an LED for indicating a position at which a failure has occurred. The alarm holding system may light the LED for an extremely short period of time, or as long as any desired interval such as one second or one minute.

FIG. 1 shows the system construction of a conventional alarm holding system. The alarm holding system of FIG. 1 includes an alarm detection apparatus 100 and an alarm processing apparatus 200. The alarm detection apparatus 100 includes a detection part 110 for detecting an input alarm, a lighting holding process part 120 for holding a lighting by means of the detected alarm and a holding pulse, and a display/transfer part 130 for displaying and transferring the held alarm.

The alarm processing apparatus 200 includes an alarm detection part 210 for detecting an alarm from a signal received from another alarm detection apparatus or the alarm detection apparatus 100, a one-second holding timer 220 for holding a pulse for one second, and for sending the holding pulse to the lighting holding process part 120 of the alarm detection apparatus 100, a lighting holding process part 230, and a display part 240.

The conventional alarm holding system is configured such that the alarm detection apparatus 100 detects an alarm and sends the detected alarm to the alarm processing apparatus 200. The one-second holding timer 220 for transferring the alarm transfers the held pulse to the alarm detection apparatus 100 after a passage of one second is detected (the time can be arbitrarily set). The alarm detection apparatus 100 detects the held pulse and displays the alarm according to the timing at which the held pulse is detected.

However, the above described alarm holding system has a problem in that there is created a difference between the timing at which the alarm display is held in the alarm processing apparatus 200 by means of the holding pulse, and a timing at which the alarm display of the alarm detection apparatus 100 is held with the result that the alarm display state of the apparatuses show a difference.

FIG. 2 shows timings of pulses occurring in the conventional alarm holding system. In FIG. 2, (a) shows the output from the detection part 110 of the alarm detection apparatus 100. (b) shows the holding pulse sent from the one-second holding timer 220 of the alarm processing apparatus 200 to the lighting holding process part 120 of the alarm detection apparatus 100. (c) shows the output signal from the lighting holding process 120 part of the alarm processing apparatus 200. (e) shows the signal sent from the one-second holding timer 220 of the alarm processing apparatus 200 to the lighting holding process part 230. (f) shows the signal output from the lighting holding process part 230 to the display part 240. Referring to FIG. 14, because of the time difference between the signal shown in (b) and the signal shown in (e), and because of the time difference between the signal shown in (a) and the signal shown in (d), there is a lack of synchronization. Because the alarm output (c) shows a drop, the holding pulse of the alarm cannot be held by the alarm detection apparatus 100. Instead, the alarm processing apparatus 200 holds the alarm output signal. This arrangement may cause a malfunction to occur in the alarm holding system, thus creating a problem in alarm management of the apparatuses.

SUMMARY OF THE INVENTION

Accordingly, it is an object of the present invention to provide a synchronized alarm holding system in which the aforementioned problem is resolved, and in which the alarm display state of the alarm detection apparatus and that of the alarm processing apparatus are the same.

Another and more specific object of the present invention is to provide a synchronized alarm holding system wherein synchronizing means is provided in at least one of two apparatuses, that is, an alarm detection apparatus for detecting an externally input alarm, and an alarm processing apparatus for displaying an alarm detection signal received from the alarm detection apparatus or another alarm detection apparatus, and for transferring the alarm detection signal to another apparatus.

According to the synchronized alarm holding system of the present invention, the difference between apparatuses concerning the alarm process is eliminated such that the same alarm is held for a predetermined period of time in different apparatuses before being displayed in a display part, and such that the alarm process of the apparatuses are synchronized by using a function for holding the alarm.

In one aspect of the present invention, the alarm detection apparatus outputs, when a timing pulse for holding an alarm for a predetermined period of time is input, response information (ACK information) indicating the holding of a display of an alarm is output. The alarm processing apparatus holds the alarm information only when the response information is returned. The held alarm and the response information from another apparatus are subjected to logical sum process. By using a timer capable of outputting a pulse after a predetermined time, the alarm detection apparatus and the alarm processing apparatus can display the alarm in a synchronized manner.

In another aspect of the present invention, when the alarm is detected by the alarm detection apparatus, the detected alarm and the alarm held for a predetermined time (s1) in the alarm processing apparatus are subjected to a logical sum process so that the alarm is displayed. The alarm processing apparatus displays the alarm such that the alarm is held for a predetermined time (s1). Accordingly, the alarm holding time of the alarm detection apparatus and that of the alarm processing apparatus are the same. Hence, it is possible to display the alarm in a synchronized manner.

In still another aspect of the present invention, The alarm detection apparatus allows the alarm to be held by means of an alarm detection function for a predetermined time specified by a timer, so that the detected alarm and the held alarm are subjected to a logical sum process and the alarm detection apparatus displays the alarm. At the same time as this, the alarm detection apparatus transfers the alarm to the alarm processing apparatus and allows the alarm to be displayed therein. In this way, the alarm can be displayed in a synchronized manner.

In still another aspect of the present invention, the alarm detected by the alarm detection apparatus is transferred to the alarm processing apparatus, where the alarm is held for a predetermined time. The held alarm is displayed in the alarm processing apparatus and in the alarm detection apparatus at the same timing.

In still another aspect of the present invention, when the alarm is detected by the alarm detection apparatus, the alarm is extended to fit the cycle of an alarm transfer frame in synch with a clock from the alarm processing apparatus, and the alarm held in the alarm detection apparatus by means of a holding timing pulse and the alarm held in the alarm processing apparatus are displayed. Thus, the difference between apparatuses concerning the display of the alarm is eliminated by allowing the alarm to be extended in the alarm detection apparatus in consideration of the delay that occurs in transferring data to the alarm processing apparatus.

BRIEF DESCRIPTION OF THE DRAWINGS

Other objects and further features of the present invention will be apparent from the following detailed description when read in conjunction with the accompanying drawings, in which.

DESCRIPTION OF PREFERRED EMBODIMENTS

A description will now be given, with reference to the drawings, of an embodiment of the present invention.

[First embodiment]

Figure 1:
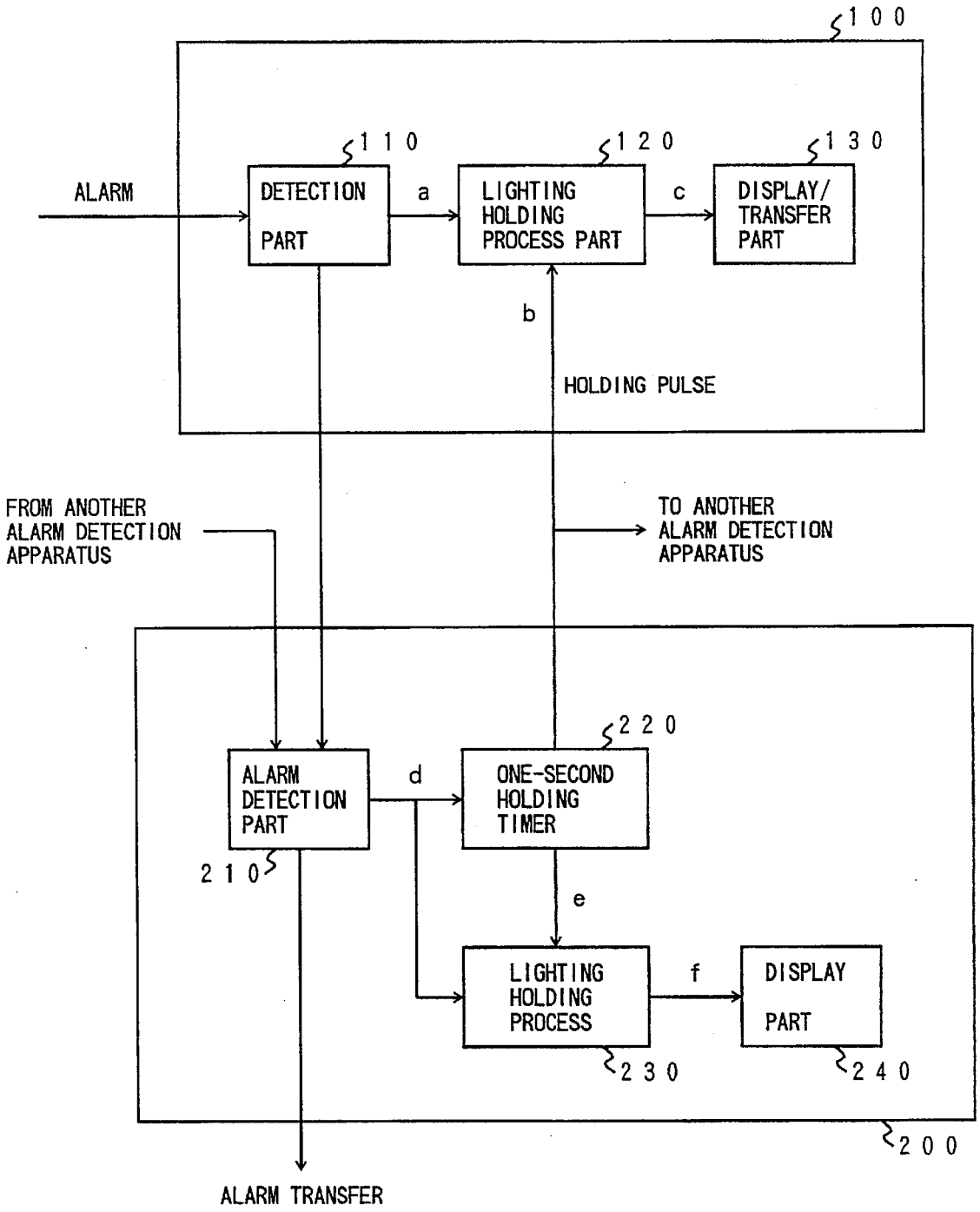
FIG. 1 shows the construction of a conventional alarm holding system.
Figure 2:
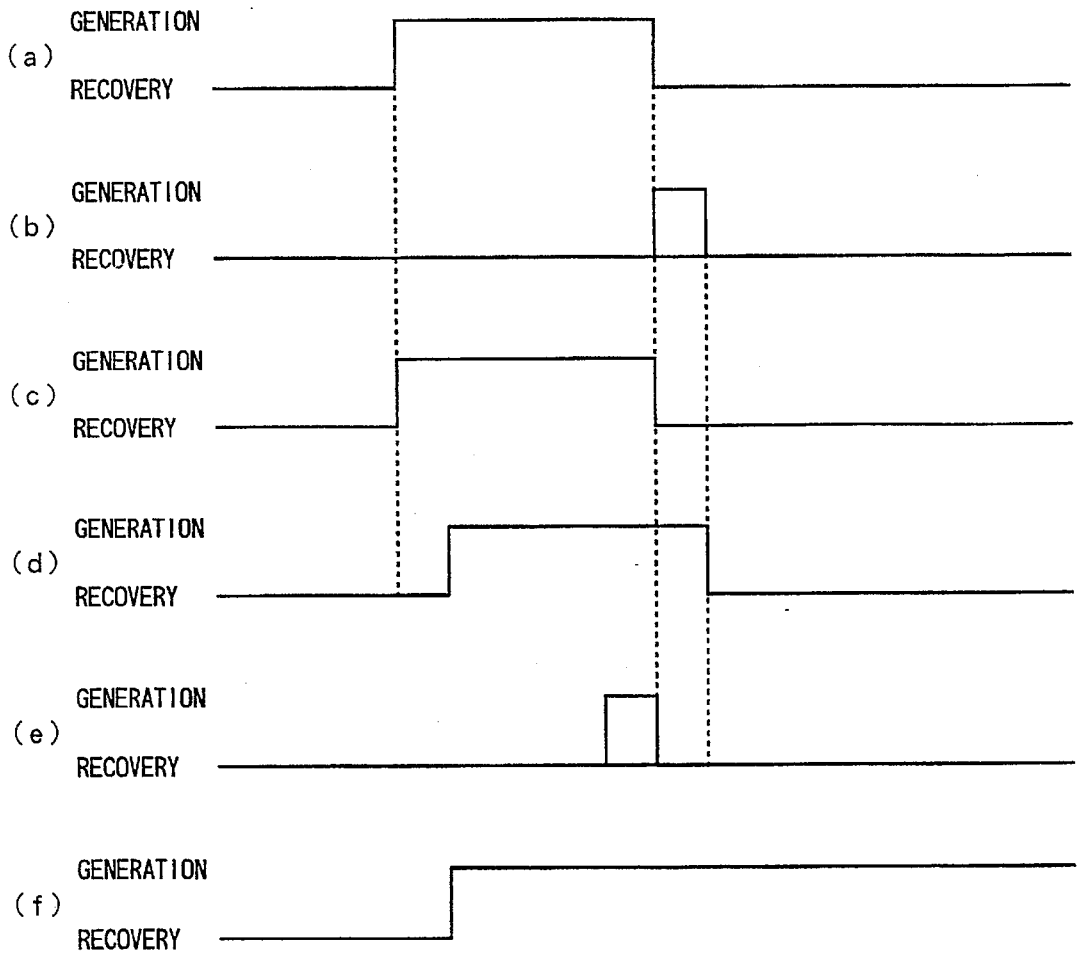
FIG. 2 shows timings of pulses occurring in the conventional alarm holding system.
Figure 3:
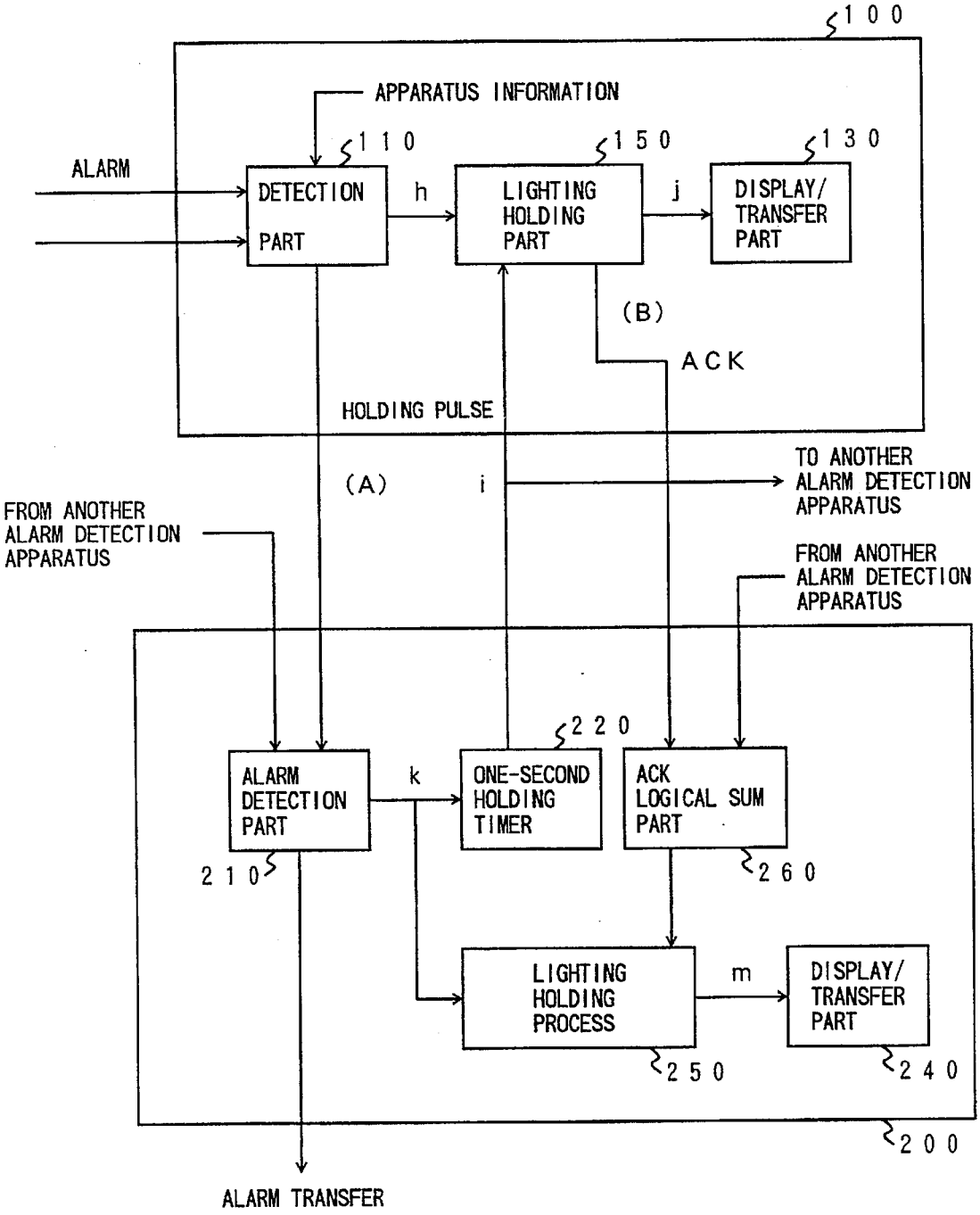
FIG. 3 shows the construction of a synchronized alarm holding system according to a first embodiment of the present invention.
Figure 13:
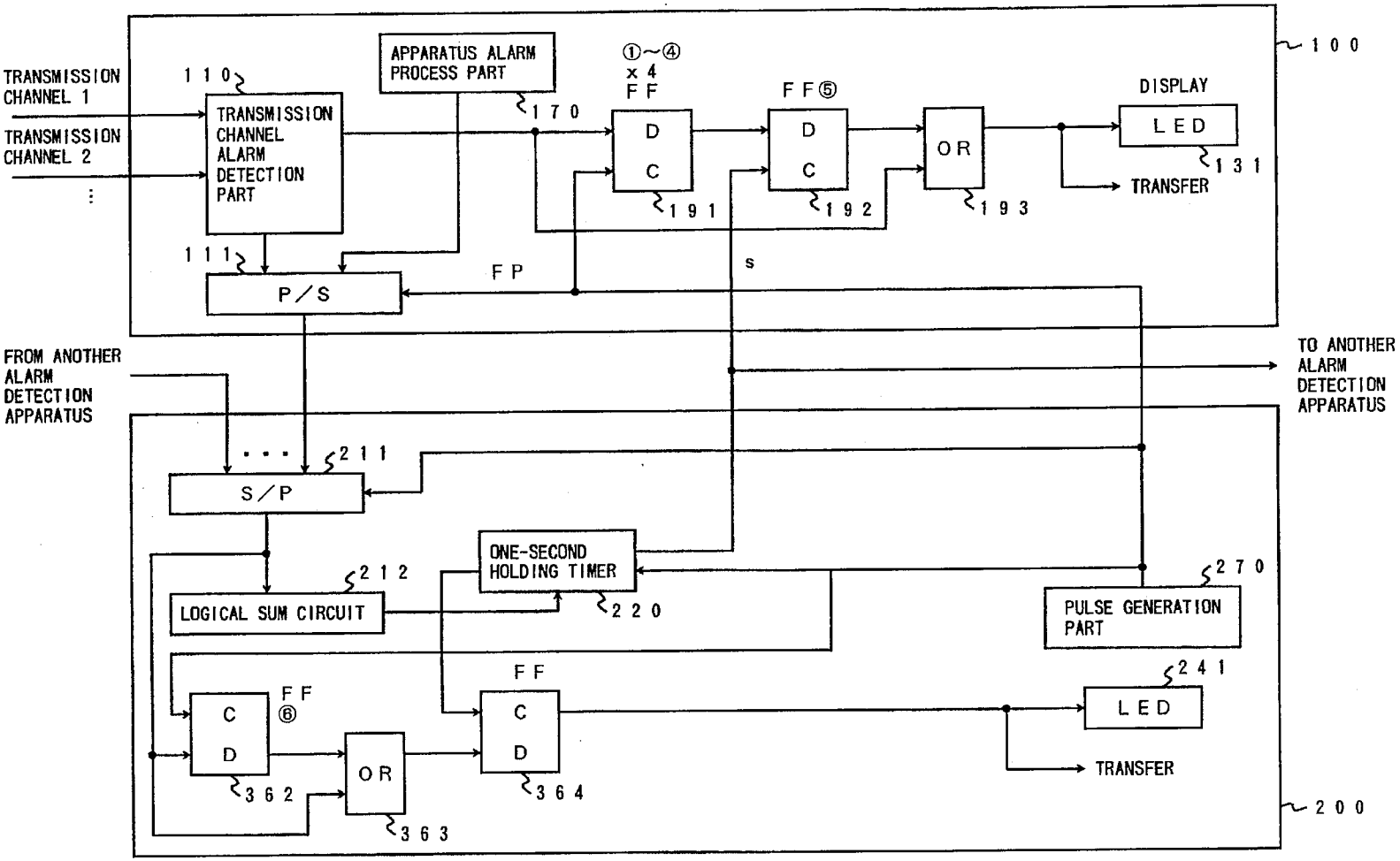
FIG. 13 shows the detailed construction of the synchronized alarm holding system according to the fifth embodiment.

FIG. 3 shows the configuration of the synchronized alarm holding system according to a first embodiment of the present invention. In the figure, those parts that are the same as the parts of FIG. 13 are designated by the same reference numerals.

The synchronized alarm holding system shown in FIG. 3 includes an alarm detection apparatus 100 and an alarm processing apparatus 200. The alarm detection apparatus 100 includes a detection part 110, a lighting holding process part 150, and a display/transfer part 130. The alarm processing apparatus 200 includes an alarm detection part 210, a one-second holding timer 220, a lighting holding process part 250, a display/transfer part 240, and an ACK signal logical sum part 260.

When an alarm is generated in the construction of FIG. 3, the detection part 110 of the alarm detection apparatus 100 recognizes an alarm and sends a resultant alarm h to the lighting holding process part 150. The lighting holding process part 150 holds the alarm in accordance with a one-second timing pulse i sent from the one-second holding timer 220 of the alarm processing apparatus 200. At the same time as this, the lighting holding process part 150 transfers, to the alarm processing apparatus 200, a signal ACK for notifying that the display of the alarm is held. Upon receipt of the ACK signal from the lighting holding process part 150 and of the alarm from another alarm detection apparatus, the ACK logical sum part 260 of the alarm processing apparatus 200 ANDs a plurality of ACK signals. The lighting holding process part 250 of the alarm processing apparatus 200 holds the display of the alarm in accordance with the alarm k detected by the alarm detection part 210 and in accordance with the ACK signal output from the ACK logical sum part 260. The lighting holding process part 250 transfer the alarm to the display/transfer part 240 so as to allow the alarm to be displayed therein.

This eliminates the difference between the display in the alarm detection apparatus 100 and that in the alarm processing apparatus 200. The release of the held alarm is effected by clearing a register which holds the alarm, using an alarm release signal (ALMOFF).

Figure 4:
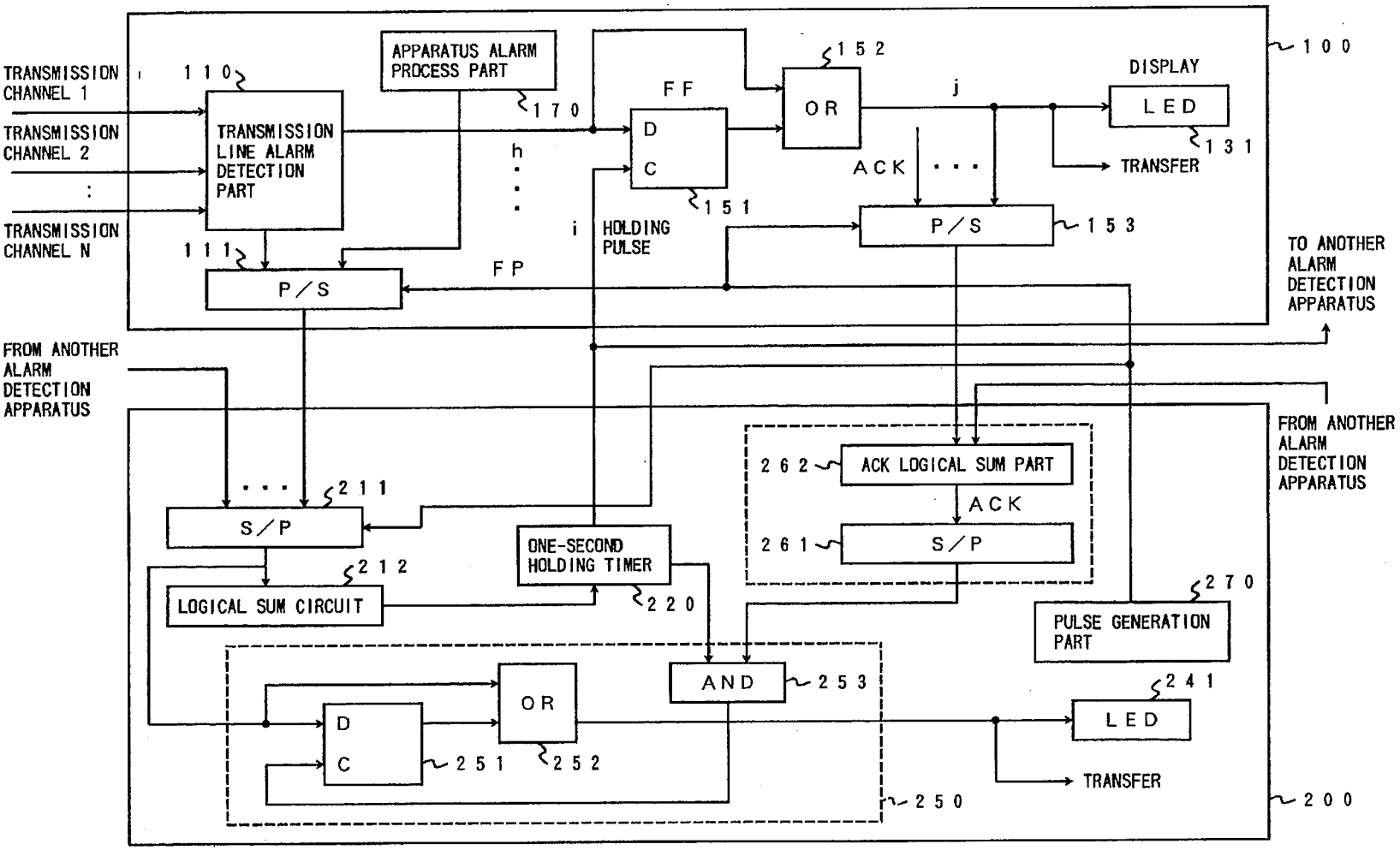
FIG. 4 shows the detailed construction of the synchronized alarm holding system according to the first embodiment.

FIG. 4 shows the detailed construction of the synchronized alarm holding system according to the first embodiment. In the figure, those parts that are the same as the parts of FIG. 3 are designated by the same reference numerals. The alarm detection apparatus 100 shown in FIG. 4 includes a detection part 110 for detecting an alarm, P/S converters 111 and 153, an apparatus information process part 170, a register 151, a logical sum circuit 152, and an LED 131. The alarm processing apparatus 200 includes an S/P converter 211, logical sum circuits 212 and 252, a one-second holding timer 220, a DC 251, an ACK logical sum part 262, an ACK logical sum part 260 having an S/P converter 261, a pulse generation part 270, a logical product circuit 253, and an LED 241.

The detection part 110 of the alarm detection apparatus 100 detects an alarm in signals transmitted via transmission channels 1–N, and transfers the alarm to the lighting holding process part 150 and the alarm processing apparatus 200. The transfer of the alarm is effected such that a plurality of alarms are multiplexed by means of the P/S converter 111. The register 151 of the lighting holding process part 150 effects a holding process of the alarm transferred from the detection part 110, by using a one-second timing holding pulse i sent from the one-second holding timer 220 of the alarm processing apparatus 200. The signal output from the register 151 and the alarm signal h sent from the detection part 110 of are subjected to a logical sum operation by means of the logical sum circuit 152. The result of the logical sum operation is displayed in the LED 131. The logical sum circuit 152 sends the ACK signal produced in response to the holding of the display of the alarm, to alarm processing apparatus 200 via the P/S converter 153. The ACK logical sum part 262 detects serial information from the S/P converter 153 of the alarm detection apparatus 100 and serial ACK information which has the same format as the serial information from the S/P converter 153, and which is derived from another alarm detection apparatus. The ACK information from different alarm detection apparatuses are then subjected to S/P conversion by means of the S/P converter 261.

Figure 5:
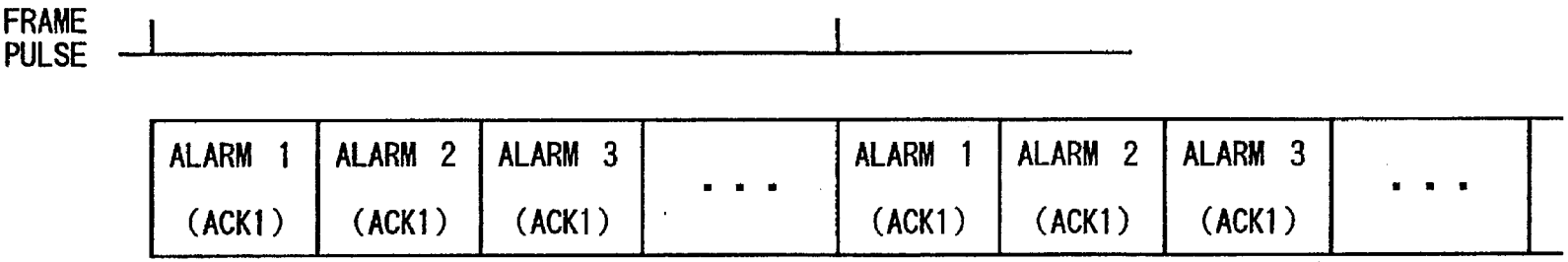
FIG. 5 shows an example of an alarm signal format according to a first embodiment of the present invention.

FIG. 5 shows an example of the format of the alarm signal in the first embodiment. The format shown in FIG. 5 applies to a frame pulse (A) sent from the detection part 110 of the alarm detection apparatus 100 shown in FIG. 3 to the alarm detection part 210 of the alarm processing apparatus 200, and to a frame pulse (B) sent from the lighting holding process part 150 to the ACK logical sum part 260.

The S/P converter 211 of the alarm processing apparatus 200 detects the multiplexed alarm signal. The S/P converter 211 detects an alarm signal in the alarm sent from another alarm detection apparatus, the alarm sent from the alarm detection apparatus 100, and a signal from the pulse generation part 270 of the alarm processing apparatus 200. The signal detected by the S/P converter 211 is sent to the logical sum circuit 212, and the DC converter 251 and the logical sum circuit 252 of the lighting holding process part 250. When the signal subjected to the logical sum process by the logical sum circuit 212 is input to the one-second holding timer 220 as a trigger, a passage of one second is detected. After one second, the one-second holding timer 220 outputs holding pulses several times to the alarm detection apparatus 100. The holding pulses are output several times in order to prevent the pulses from being masked as a result of the logical product process of the logical product circuit 252. The lighting holding process part 250 holds the lighting only when the ACK signal is returned from the alarm detection apparatus 100 via the P/S converter 261. The LED 241 remains lighted while the alarm is held in the lighting holding process part 250.

When the one-second holding timer 220 of the alarm processing apparatus 200 notifies the register 151 of the alarm detection apparatus 100 of the passage of one second in the form of an alarm release signal, the register 151 is reset.

[Second embodiment]

A description will now be given of a second embodiment.

Figure 6:
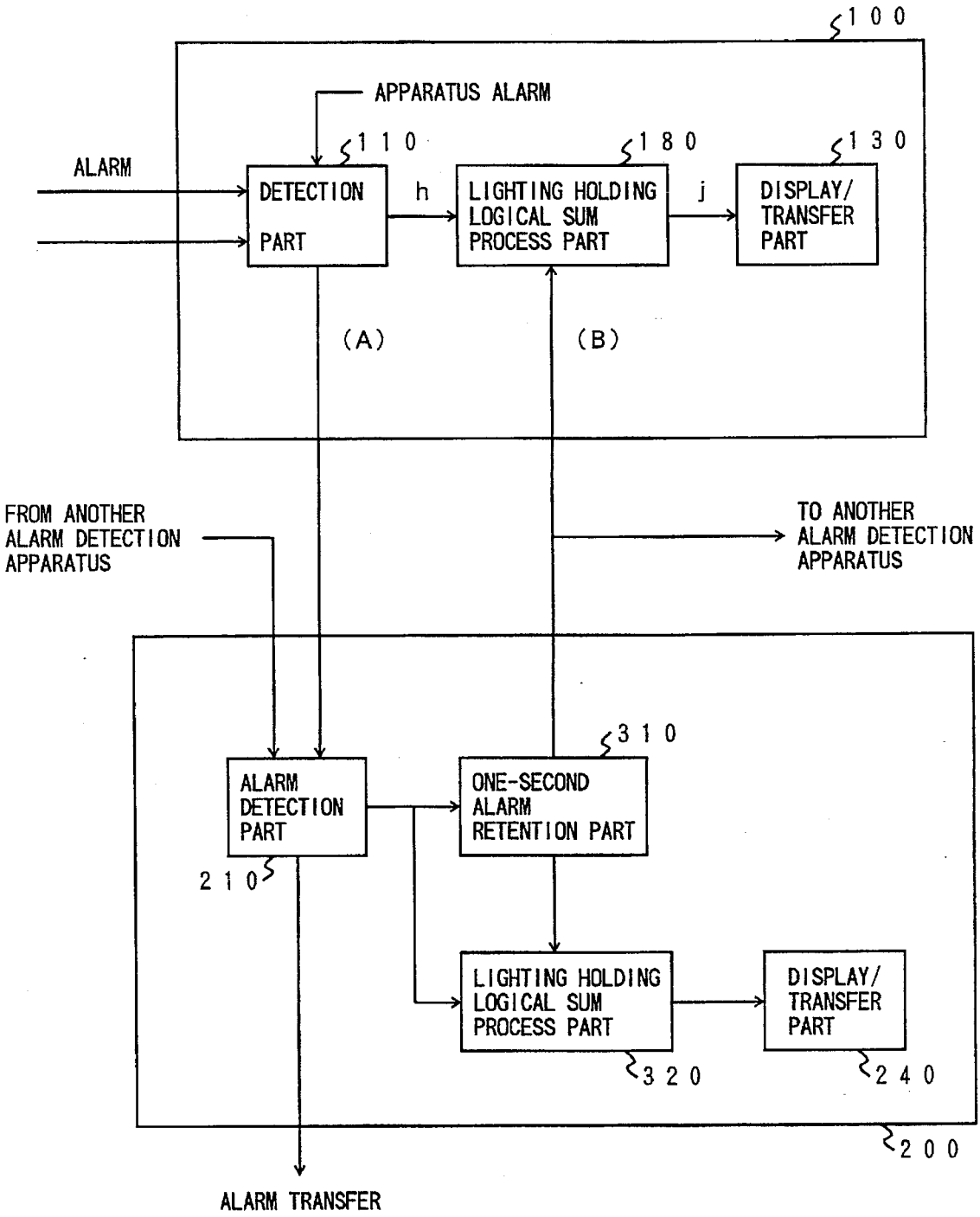
FIG. 6 shows the construction of the synchronized alarm holding system according to a second embodiment of the present invention.

FIG. 6 shows the construction of a synchronized alarm holding system according to a second embodiment of the present invention. In the figure, those parts that are the same as the parts of FIG. 3 are designated by the same reference numerals, and the description thereof is omitted. Referring the FIG. 6, the alarm detection apparatus 100 is configured such that a lighting holding logical sum process part 180 is provided instead of the lighting holding process part 150 of FIG. 3.

In addition to the alarm detection part 210 and the display/transfer part 240 of the alarm processing apparatus 200 shown in FIG. 3, the alarm processing apparatus 200 of FIG. 6 includes the one-second alarm holding part 310 for holding an alarm for one second, and for transferring the holding of the alarm to the alarm detection apparatus, and a lighting holding logical sum process part 320 for subjecting the alarm from the alarm detection part 210 and the held alarm from the one-second alarm holding part 310 to a logical sum process.

In the alarm holding system shown in FIG. 6, the detection part 110 of the alarm detection apparatus 100 detects an alarm transmitted via the transmission channel, and sends the detected alarm to the lighting holding logical sum process part 180. The lighting holding logical sum process part 180 subjects the alarm from the detection part 110 and the one-second holding alarm from an external apparatus to a logical sum process and causes the alarm to be displayed in the display/transfer part 130. On the basis of the multiplexed alarm from the detection part 110 of the alarm detection apparatus 100, the one-second alarm holding part 310 of the alarm processing apparatus 200 holds the alarm for one second and transfers the alarm at a predetermined timing to the lighting holding logical sum process part 180 and the lighting holding logical sum process part 320, simultaneously. As a result of this, there will be no difference in how the alarm is displayed in the alarm detection apparatus 100 and in the alarm processing apparatus 200.

The format of the alarm signal is the same as that of FIG. 5 of the first embodiment.

Figure 7:
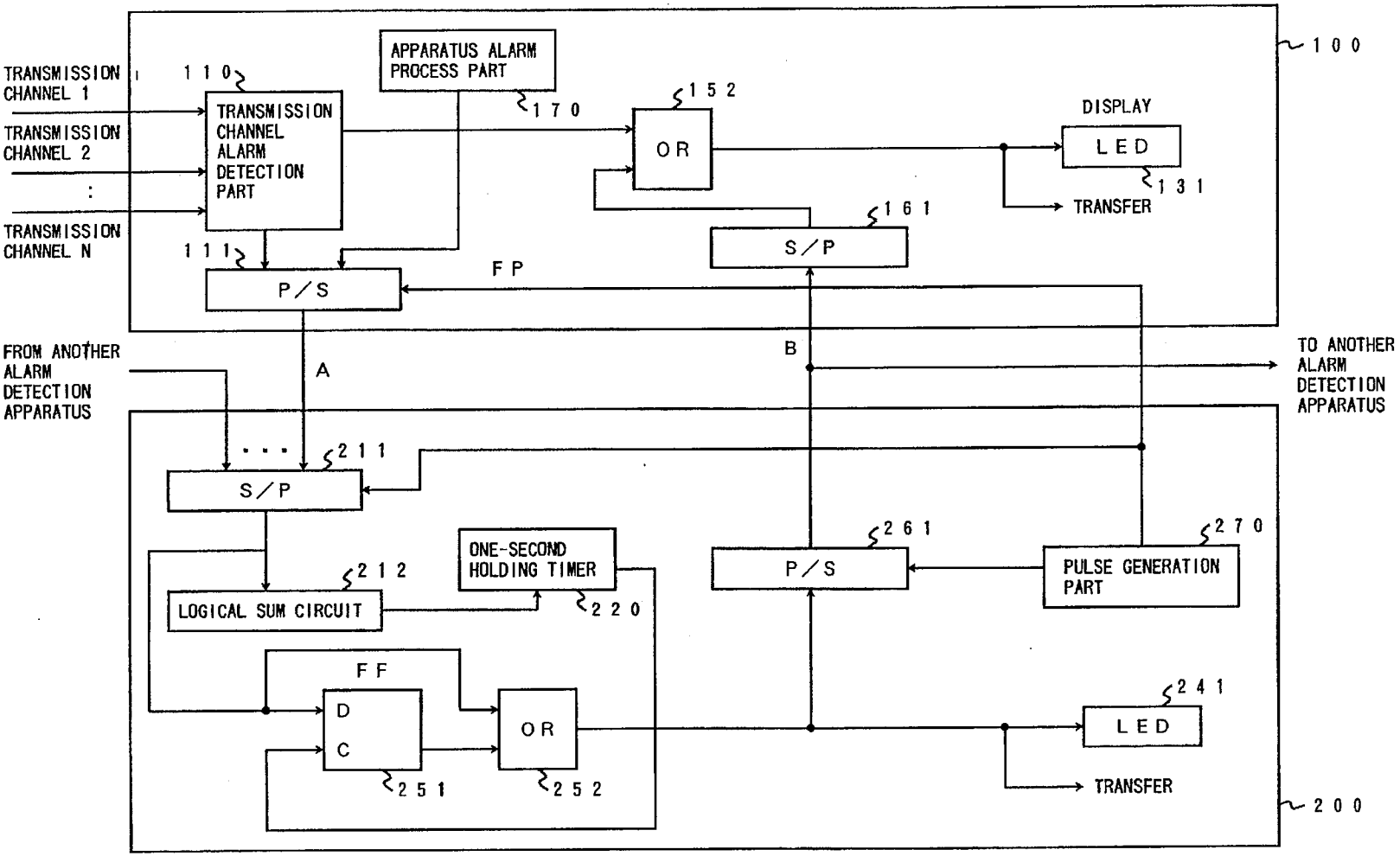
FIG. 7 shows the detailed construction of the synchronized alarm holding system according to the second embodiment.

FIG. 7 shows the detailed construction of the synchronized alarm holding system according to the second embodiment. The alarm detection apparatus 100 of FIG. 7 includes the detection part 110 for detecting an alarm transmitted via a plurality of transmission channels, the apparatus alarm process part 170, the logical sum circuit 152, the LED 131, the S/P converter 161, and the P/S converter 111. The alarm processing apparatus 200 includes the S/P converter 211, the logical sum circuit 212, the one-second holding timer 220, the register 251, the logical sum circuit 252, the P/S converter 261, the pulse generation part 270, and the LED 241. A description will be given of the operation of the construction shown in FIG. 7.

The detection part 110 of the alarm detection apparatus 100 transfers the alarms received via a plurality of transmission channels 1–N to the logical sum circuit 152, and sends the multiplexed alarm to the S/P converter 211 of the alarm processing apparatus 200.

The logical sum circuit 152 of the lighting holding process part 150 subjects the alarm from the detection part 110 and the held alarm from an external apparatus to a logical sum process. The output signal from the logical sum circuit 152 is displayed in the LED 131. The held alarm is held such that the multiplexed signal sent from the alarm processing apparatus 200 is extracted by the S/P converter 161.

The alarm detection part 210 of the alarm processing apparatus 200 detects the multiplexed alarm from the alarm detection apparatus 100 by means of the S/P converter 211. The source of the transmitted alarm is not limited to one, but the multiplexed alarms from several alarm detection apparatuses are detected and transferred.

The one-second holding timer 220 of the one-second alarm holding part 310 receives as a trigger the alarm from the alarm detection part 210. The one-second holding timer 220 then measures the passage of one second. The register 251 holds the alarm for one second, and the alarm and the alarm from the register 251 are subjected to a logical sum process. After one second, the register 251 outputs the held alarm to the alarm detection apparatus 100. The held alarm output to the alarm detection apparatus 100 is multiplexed via the P/S converter 261 before being transferred to the alarm detection apparatus 100. Subsequently, the logical sum circuit 152 of the alarm detection apparatus 100 subjects the alarm from the alarm detection part 110 and the output from the one-second alarm holding part 310 to the logical sum process.

When the one-second holding timer 220 of the alarm processing apparatus 200 notifies the register 251 of the passage of one second in the form of an alarm release signal, the register 251 is reset.

[Third embodiment]

A description will be given of the third embodiment.

Figure 8:
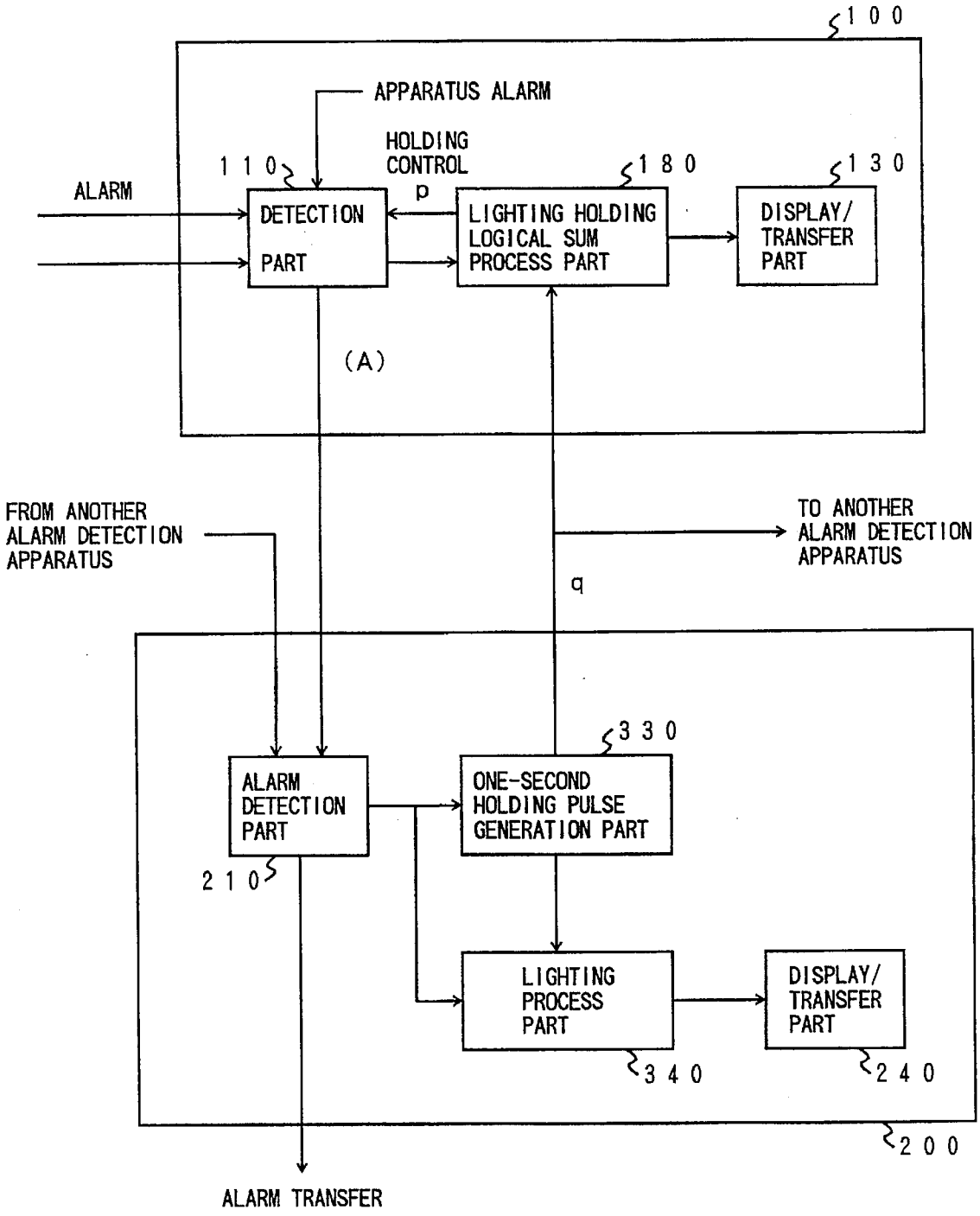
FIG. 8 shows the construction of the synchronized alarm holding system according to a third embodiment of the present invention.

FIG. 8 shows the construction of the synchronized alarm holding system according to a third embodiment of the present invention. The alarm detection apparatus 100 of FIG. 8 has the same construction as the alarm detection apparatus 100 of FIG. 6. The alarm processing apparatus 200 of FIG. 8 differs from the alarm processing apparatus 200 of the first and second embodiments in that a one-second holding pulse generation part 330 and a lighting process part 340 are provided.

Referring to FIG. 8, the detection part 110 of the alarm detection apparatus 100 detects an occurrence of an alarm and sends the alarm to the lighting holding logical sum process part 180. The lighting holding logical sum process part 180 subjects the alarm from the detection part 110 and the held pulse transferred from the one-second holding pulse generation part 330 of the alarm processing apparatus 200 of an external apparatus to a logical sum process, so as to hold the alarm state and light the alarm. The lighting holding logical sum process part 180 also transfers a holding control signal p to the detection part 110. Upon receipt of the holding control signal p, the detection part 110 holds the alarm (A) contained in the signals to be transmitted to the alarm processing apparatus 200 and transfers the alarm (A) to the alarm processing apparatus 200. The lighting process part 340 of the alarm processing apparatus 200 performs a normal alarm lighting process. The holding operation is executed by the detection part 110 of the alarm detection apparatus 100, so that the difference between the display of the alarm detection apparatus 100 and that of the alarm processing apparatus 200 is eliminated.

The format of the alarm signal of the third embodiment is the same as that of the first embodiment.

Figure 9:
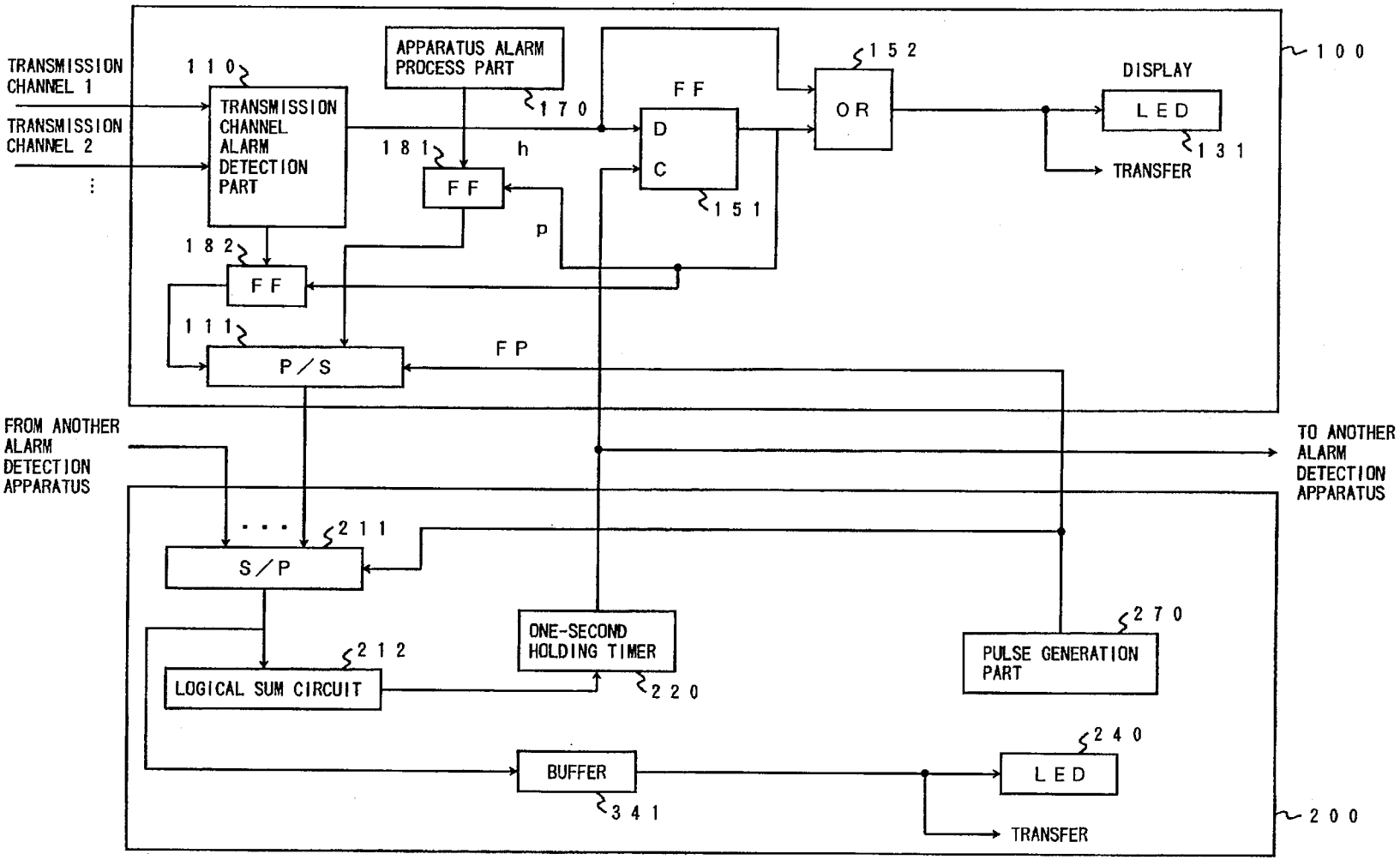
FIG. 9 shows the detailed construction of the synchronized alarm holding system according to the third embodiment.

FIG. 9 shows the detailed construction of the synchronized alarm holding system according to the third embodiment. The alarm detection apparatus 100 of the third embodiment includes the detection part 110 for detecting an alarm transmitted via the plurality of transmission channels 1–N, the register 151, registers 181 and 182, the logical sum circuit 152, the P/S converter 111, and the LED 131. The alarm processing apparatus 200 includes the S/P converter 211, the logical sum circuit 212, the one-second holding timer 220, a buffer 341, the pulse generation part 270, and the LED 240.

The detection part 110 of the alarm detection apparatus 100 transfers the alarm to the register 151 embodying the lighting holding logical sum process part 180, and to the register 182. The transfer of the alarm is performed such that the alarms from the transmission channels are multiplexed before being transmitted.

The lighting holding logical sum process part 180 holds the alarm by using the alarm from the detection part 110, and the one-second holding pulse from the one-second holding timer 220 of the alarm processing apparatus 200. When the alarm is held, the lighting holding logical sum process part 180 sends a holding control signal p to the detection part 110. Upon receipt of the holding control signal p from the lighting holding logical sum process part 180, the register 181 of the detection part 110 holds the holding control signal p as the alarm to be held for the external apparatus (the alarm processing apparatus 200). The register 181 sends the holding control signal p to the alarm processing apparatus 200 via the P/S converter 111.

The alarm processing apparatus 200 detects the multiplexed alarm by using the S/P converter 211 of the alarm detection part 210. The multiplexed alarm originating in a plurality of alarm detection apparatuses is detected and transferred. The one-second holding timer 220 of the one-second holding pulse generation part 330 measures a passage of one second and sends a holding pulse q to the alarm detection apparatus 100 after one second. The buffer 341 embodying the lighting process part 340 holds the alarm transferred from the alarm detection part 210 (S/P converter 211). When the buffer 341 holds the alarm, the lighting process circuit 340 does not perform a holding process using the one-minute pulse, because the alarm from the alarm detection part 210 is already held and transferred by the registers 181 and 182 of the alarm detection apparatus 100.

The registers 151, 181 and 182 are reset and the alarms held therein are released by outputting an alarm release (ALMOFF) from the one-second holding timer 220 of the alarm processing apparatus 200.

[Fourth embodiment]

Figure 10:
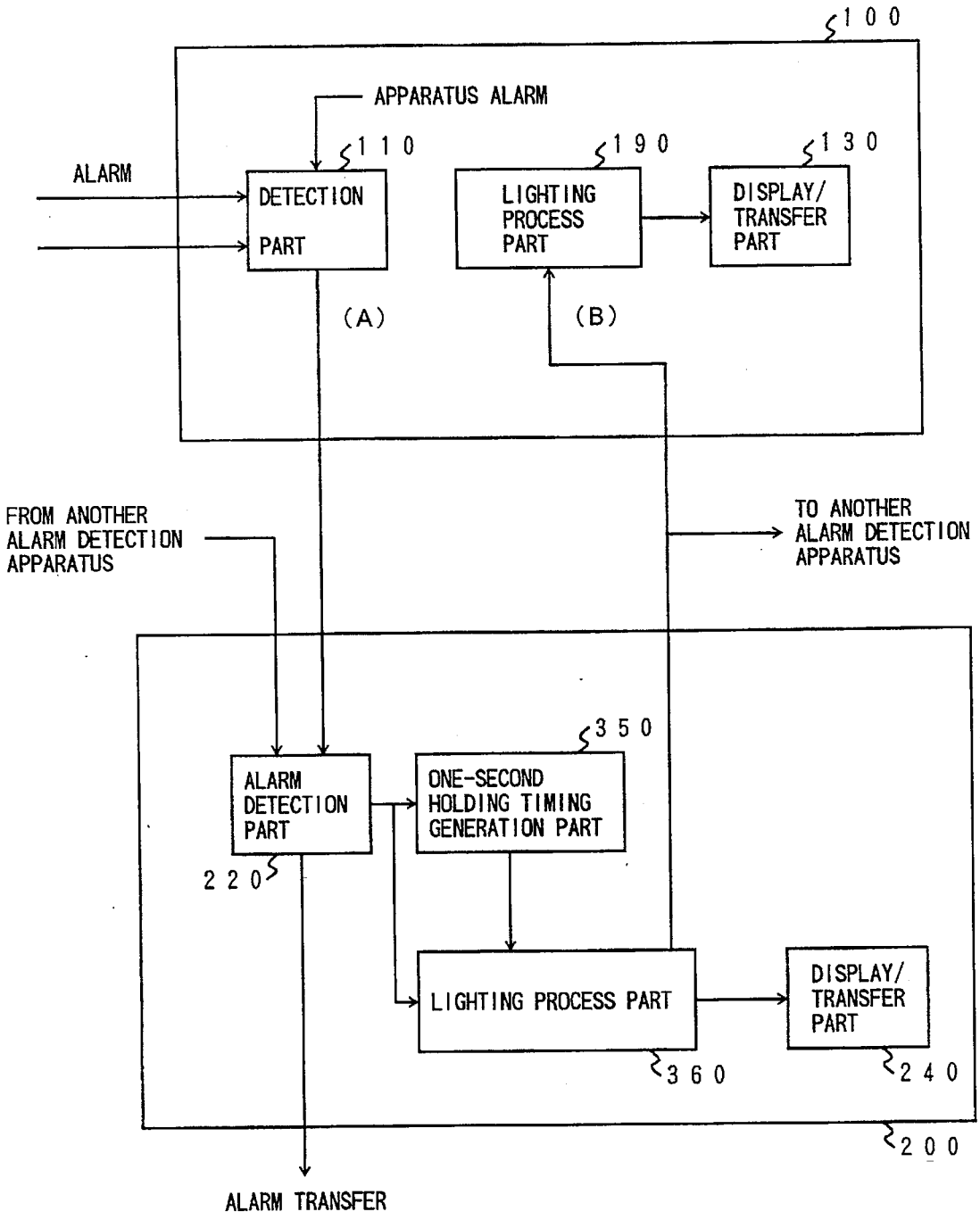
FIG. 10 shows the construction of the synchrnonized alarm holding system according to a fourth embodiment of the present invention.

FIG. 10 shows the construction of a synchronized alarm holding system according to a fourth embodiment. The fourth embodiment differs from the previous embodiments in that the alarm detection apparatus 100 includes a lighting process part 190, and in that the alarm processing apparatus 200 includes a one-second holding timing generation circuit 350 and a lighting process part 360.

The detection part 110 of the alarm detection apparatus 100 detects an alarm, and transfers the alarm to the alarm detection part 220 of the alarm processing apparatus 200. The alarm detection part 210 of the alarm processing apparatus 200 transfers the multiplexed alarm to the one-second holding timing generation circuit 350 and the lighting process part 360. The lighting processing part 360 holds the alarm at a holding timing signal r supplied from the one-second holding timing generation circuit 350 so as to light the display/transfer part 240. The alarm held by the one-second timing generation circuit 350 is transferred to the lighting process part 190 of the alarm detection apparatus 100 as the multiplexed data. The lighting process part 190 displays and transfers the alarm by means of the display/transfer part 130.

Figure 11:
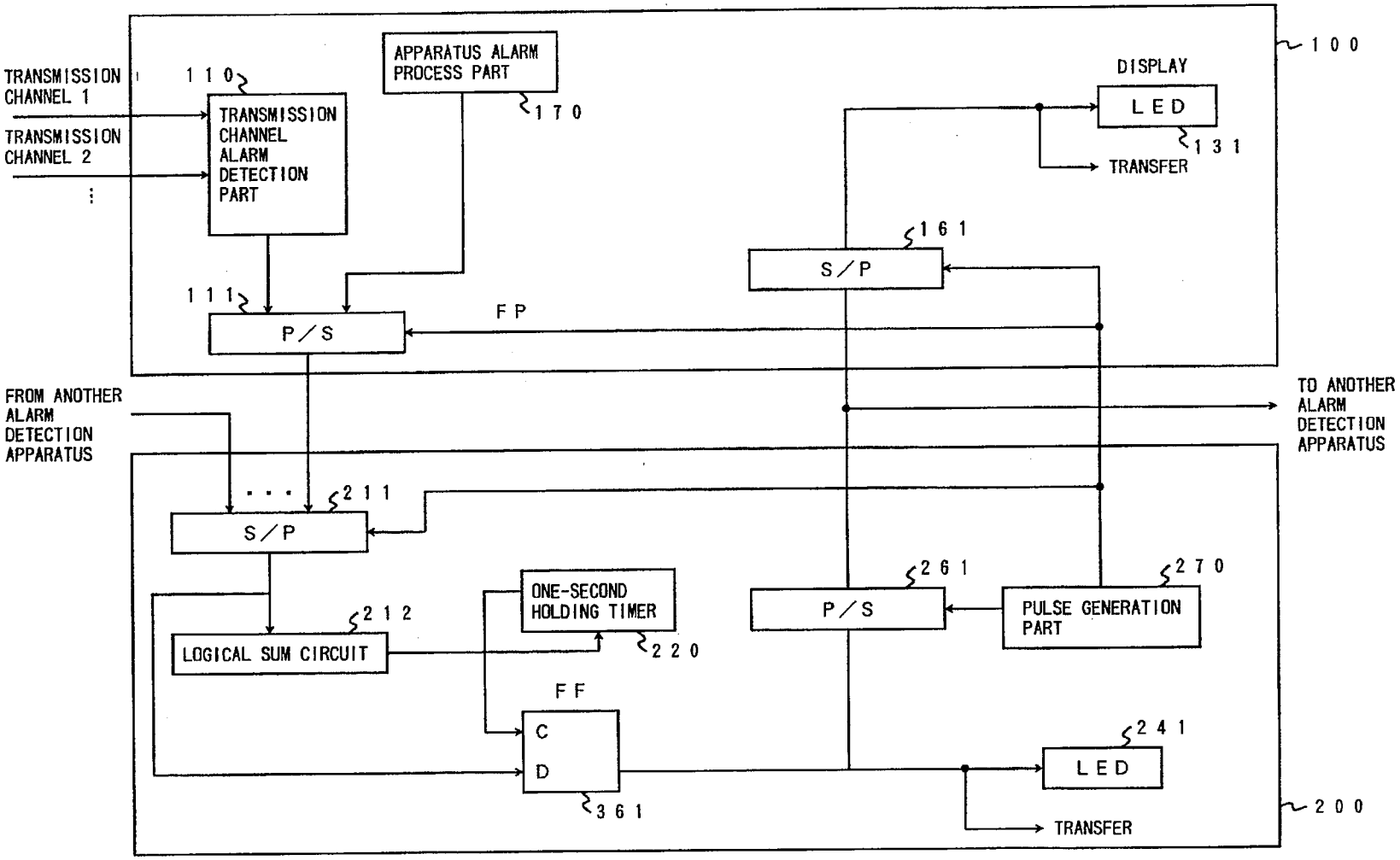
FIG. 11 shows the detailed construction of the synchronized alarm holding system according to the fourth embodiment.

FIG. 11 shows the detailed construction of the synchronized alarm holding system according to the fourth embodiment of the present invention. The alarm detection apparatus 100 of the fourth embodiment includes the detection part 110, the apparatus alarm process part 170, the P/S converter 111, the S/P converter 161, and the LED 131. The alarm processing apparatus 200 includes the S/P converter 211, the logical sum circuit 212, the one-second holding timer 220, the P/S converter 261, the pulse generation part 270, and the LED 241. The detection part 110 of the alarm detection apparatus 100 detects an alarm transmitted via the transmission channel and sends the alarm to the alarm processing apparatus 200 via the P/S converter 111. Upon receipt of the alarm from the alarm detection apparatus 100, the S/P converter 211 of the alarm processing apparatus 200 sends the alarm from the alarm detection apparatus 100 and the alarm from another alarm detection apparatus to a register 361 and the logical sum circuit 212. The one-second holding timer 220 receives the alarm from the logical sum circuit 212 as a trigger and measures a passage of one second. Upon receipt of the alarm and the received from the one-second holding timer 220, the register 361 transfers the alarm to the LED 241 for one second so as to allow the alarm to be displayed therein. After one second, the register 361 outputs the holding pulse to the alarm detection apparatus 100 via the P/S converter 261. Upon receipt of the holding pulse via the S/P converter 161, the alarm detection apparatus 100 displays the alarm in the LED 131.

Since the holding operation is executed only by the alarm processing apparatus 200, the difference between the alarm display in one apparatus from that in another is eliminated.

[Fifth embodiment]

Finally, a description will be given of a fifth embodiment.

Figure 12:
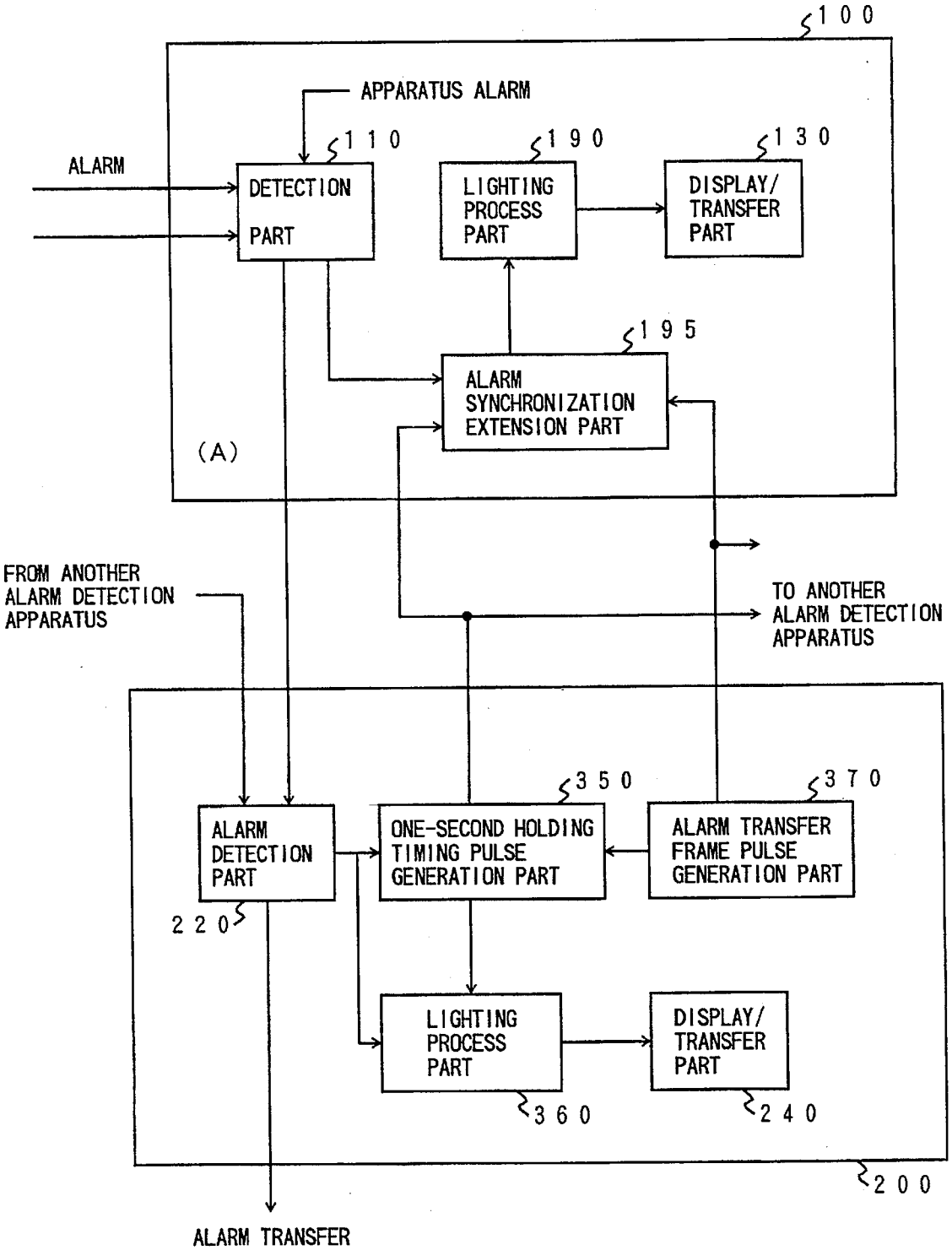
FIG. 12 shows the construction of the synchronized alarm holding system according to a fifth embodiment of the present invention.

FIG. 12 shows the construction of a synchronized alarm holding system according to the fifth embodiment. The alarm detection apparatus 100 of the fifth embodiment includes a lighting process part 190 and an alarm synchronization extension part 195; and the alarm processing apparatus 200 of the fifth embodiment includes an alarm transfer frame pulse part 370.

The detection part 110 of the alarm detection apparatus detects an alarm and sends the alarm to the alarm processing apparatus 200 and the alarm synchronization extension part 195. The alarm synchronization extension part 195 extends, by one transfer cycle, the input alarm by using a transfer frame pulse, and executes the holding operation of the alarm using the one-second timing pulse generation circuit 350 synchronized to the transfer frame of the alarm processing apparatus 200. The alarm processing apparatus 200 is operated in sync with the alarm transfer frame. The alarm detection apparatus 100 performs the extension of the alarm such that the delay in the data transfer to the alarm processing apparatus 200 is allowed for. Hence, the difference between the display of the alarm in one apparatus and that in another is eliminated.

FIG. 13 shows the detailed construction of the synchronized alarm holding system according to the fifth embodiment. The alarm detection apparatus 100 of the fifth embodiment includes the detection part 110, the P/S converter 111, the apparatus alarm process part 170, registers 191 that constitute the alarm synchronization extension part 195, a register 192, a logical sum circuit 193, and the LED. The alarm processing apparatus 200 of the fifth embodiment includes the S/P converter 211, the one-second holding timer 220, the logical sum process part 361, registers 362 and 364, a logical sum circuit 363, the pulse generation part 270 and the LED 241.

The detection part 110 of the alarm detection apparatus 100 sends the alarm to the alarm processing apparatus 200 via the P/S converter 111. The detection part 110 also sends the alarm to the four registers 191 of the alarm synchronization extension part 195 and to the logical sum circuit 193. The register 912 embodying the lighting process part 190 lights the LED 131 on the basis of the held data from the registers 191 that constitute the alarm synchronization extension part 195.

The alarm synchronization extension part 195 extends the alarm from the detection part 110 by one alarm transfer cycle. The register 192 performs the alarm holding operation by using the extended data and the one-second timing pulse s transferred from the one-second holding timer 220.

The S/P converter 211 of the alarm detection part 210 of the alarm processing apparatus 200 detects the multiplexed alarm. The detected alarm is transferred to the logical sum process part 361 and the register 362. Triggered by the input of the alarm, the one-second holding timer 220 measures a passage of one second. After one second, the one-second holding timer 220 outputs the holding pulse s to the register 192 of the alarm detection apparatus 100.

The alarm of the register 362 is input to the logical sum circuit 363, and the alarm subjected to the logical sum operation is transferred to the register 364. The alarm is transferred to the LED 241 and displayed therein for one second, the passage of one second being measured by the one-second holding timer 220.

Figure 14:
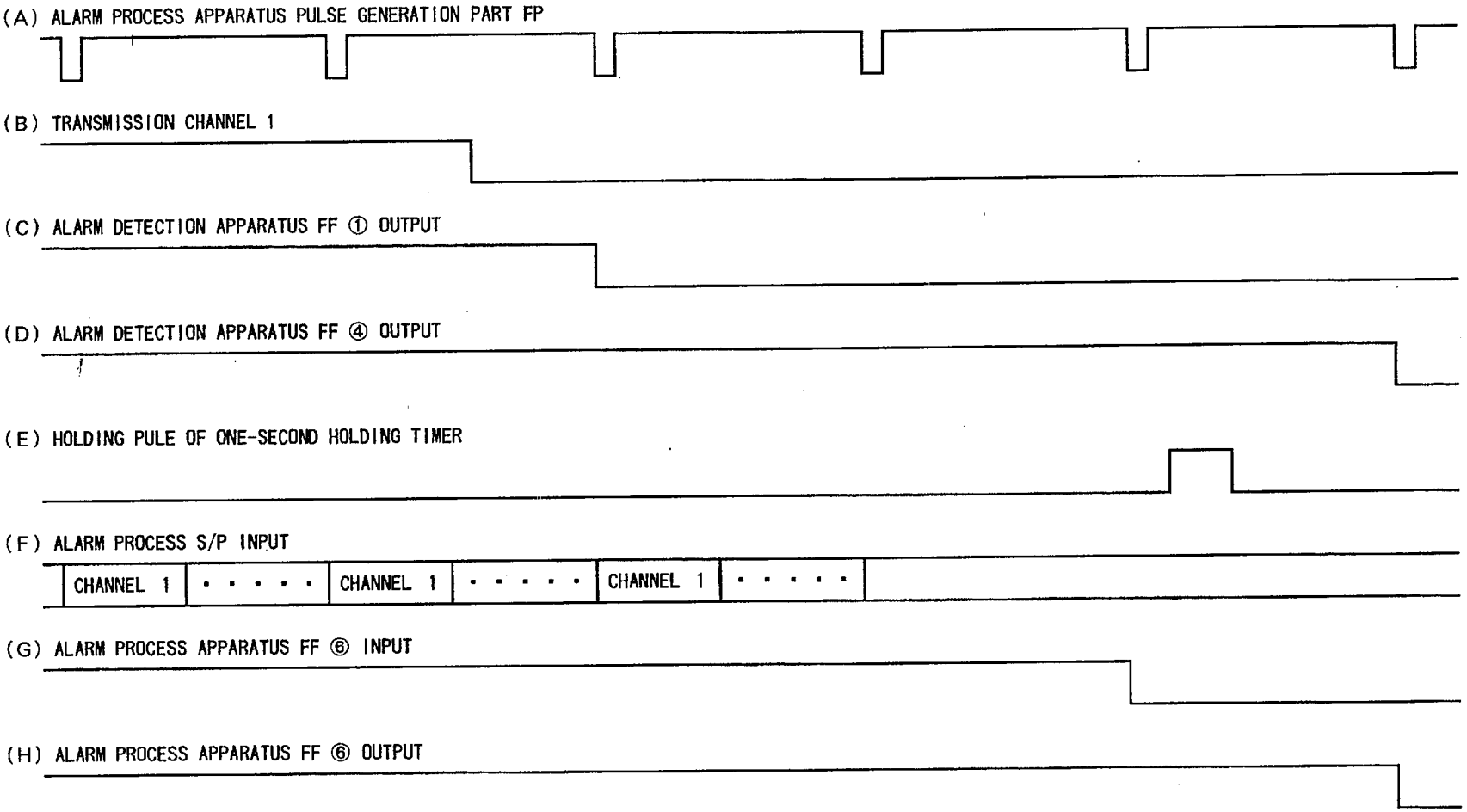
FIG. 14 shows timings of signals occurring in different parts of an alarm detection apparatus and an alarm processing apparatus according to the fifth embodiment.

FIG. 14 is a time chart of signals occurring in the alarm detection apparatus and the alarm processing apparatus of the fifth embodiment. (A) of FIG. 14 shows a clock signal in the pulse generation part 270 of the alarm processing apparatus 200; (B) shows an alarm information signal input via the transmission channel 1; (C) shows an output signal of the first of the registers 191 of the alarm detection apparatus 100; (D) shows the output signal of the last of the registers 191 of the alarm detection apparatus; (E) shows the holding pulse of the one-second holding timer 220; (F) shows the input to the S/P converter 211 of the alarm processing apparatus 200; (G) shows the input of the alarm information to the register 362 of the alarm processing apparatus 200; and (H) shows the output of the alarm information from the register 362 of the alarm processing apparatus 200. As can be seen in this example, the output (D) of alarm information from the register 191 of the alarm detection apparatus 100, and the output (H) of alarm information from the register 362 of the alarm processing apparatus 200 are synchronized.

The present invention is not limited to the above described embodiments, and variations and modifications may be made without departing from the scope of the present invention.

What is claimed is:

1. A synchronized alarm holding system, wherein synchronizing means is provided in at least one of two apparatuses including an alarm detection apparatus for detecting an externally input alarm, and an alarm processing apparatus for displaying an alarm detection signal received from said alarm detection apparatus or another alarm detection apparatus, and for transferring said alarm detection signal to another apparatus, the synchronizing alarm holding system comprising:

said alarm detection apparatus having first alarm detection means for detecting alarm information issued externally when a failure has occurred, and for transferring a detected alarm to an external apparatus, first lighting holding means for holding the alarm information for a predetermined time required for the display thereof, when said alarm information is detected by said first alarm detection means, and first display/transfer means for displaying said alarm information, and for transferring the same to said external apparatus; and said alarm processing apparatus having second alarm detection means for detecting externally issued alarm information, and for transferring the detected alarm information, holding time setting means for outputting a holding pulse for holding the alarm information for a predetermined time to said first lighting holding means a plurality of times, when the alarm information is transferred from said second alarm detection means, an alarm holding instruction means for instructing the holding of said alarm information when a response signal indicating the holding of an alarm is received from another apparatus, second lighting holding means for holding said alarm information for a predetermined time required for the display thereof, in response to the alarm holding instruction from said alarm holding instruction means, and second display/transfer means for displaying said alarm information, and for transferring the same to said external apparatus, wherein upon receipt of holding pulses a plurality of times from said holding time setting means, said first lighting holding means returns a response signal indicating that the alarm information has been held on the basis of said holding pulse.

2. The synchronized alarm holding system as claimed in claim 1, wherein said alarm holding instruction means of said alarm processing apparatus transfers, to said second lighting holding means, the result of operation for obtaining a logical product of said response signal from said first lighting holding means and the signal from said holding time setting means.

3. The synchronized alarm holding system as claimed in claim 2, wherein said second lighting holding means has a DC converter for holding the alarm information from said second alarm detection means.

4. The synchronized alarm holding system as claimed in claim 1, wherein said holding time setting means has a timer capable of setting a time during which the alarm information is held.

5. The synchronized alarm holding system as claimed in claim 4, wherein said alarm holding part has a timer capable of setting a time during which the alarm information is held, and a register for holding the alarm information.

6. The synchronized alarm holding system as claimed in claim 1, wherein signal transmission between said alarm detection apparatus and said alarm processing apparatus is executed using multiplexed signals.

7. A synchronized alarm holding system, wherein synchronizing means is provided in at least one of two apparatuses including an alarm detection apparatus for detecting an externally input alarm, and an alarm processing apparatus for displaying an alarm detection signal received from said alarm detection apparatus or another alarm detection apparatus, and for transferring said alarm detection signal to another apparatus, the synchronizing alarm holding system comprising:

said alarm detection apparatus having first alarm detection means for detecting alarm information issued externally when a failure has occurred, and for transferring a detected alarm to an external apparatus, first lighting holding means for obtaining a logical sum of said alarm information and an externally input signal, and for holding the alarm information resulting from the logical sum operation for a predetermined time, when the alarm information is detected by said first alarm detection means, and first display/transfer means for displaying said alarm information, and for transferring the same to said external apparatus; and said alarm processing apparatus having second alarm detection means for detecting externally issued alarm information, and for transferring the detected alarm information, alarm holding part for holding the alarm information transferred from said second alarm detection means for a predetermined time, and for transferring the same to said first lighting holding means, second lighting holding means for executing an operation for obtaining the logical sum of the alarm information detected by said second alarm detection means and the alarm information transferred from said alarm holding part, and for transferring the alarm information resulting from the logical sum operation, and second display/transfer means for displaying said alarm information from second lighting holding means, and for transferring the same to said external apparatus.

8. A synchronized alarm holding system, wherein synchronizing means is provided in at least one of two apparatuses including an alarm detection apparatus for detecting an externally input alarm, and an alarm processing apparatus for displaying an alarm detection signal received from said alarm detection apparatus or another alarm detection apparatus, and for transferring said alarm detection signal to another apparatus, the synchronizing alarm holding system comprising:

said alarm detection apparatus having first alarm detection means for detecting alarm information that is externally issued when a failure has occurred, and for transferring the detected alarm information to an external apparatus, first lighting holding means for holding the alarm information when said alarm information is detected by said first alarm detection means, and first display/transfer means for displaying said alarm information, and for transferring the same to said external apparatus;

said alarm processing apparatus having second alarm detection means for detecting externally issued alarm information, and for transferring the detected alarm information, holding pulse output means for measuring a passage of a predetermined time using the alarm information transferred from said second alarm detection means as a trigger, and for outputting a holding pulse for allowing said first lighting holding means to hold the alarm information, first lighting process part for processing the lighting of alarm information output from said second alarm detection means, wherein said first lighting holding means transfers, as a holding control signal, said holding pulse output from said holding pulse outputting means and said alarm information, to said first alarm detection means, whereupon said alarm detection means holds the detected alarm information and transfers the same to said first lighting holding means, in accordance with said holding control signal, and said first lighting holding means executes the operation for obtaining a logical sum of said holding pulse and said alarm information and transfers the alarm information resulting from the logical sum operation to said first display/transfer means.

9. The synchronized alarm holding system as claimed in claim 8, wherein said first alarm detection means includes registers for holding said holding control signal received from said first lighting holding means.

10. The synchronized alarm holding system as claimed in claim 8, wherein said holding pulse outputting means has a timer for measuring a predetermined time during which the alarm information is held.

11. A synchronized alarm holding system, wherein synchronizing means is provided in at east one of two apparatuses including an alarm detection apparatus for detecting an externally input alarm, and an alarm processing apparatus for displaying an alarm detection signal received from said alarm detection apparatus or another alarm detection apparatus, and for transferring said alarm detection signal to another apparatus, the synchronizing alarm holding system comprising:

said alarm detection apparatus having first alarm detection means for detecting alarm information externally issued when there is a failure, and for transferring the detected alarm information to an external apparatus, first lighting process means for receiving, from said external apparatus, holding data for holding the alarm information, and for transferring the alarm information, first display/transfer means for displaying the alarm information transferred from said lighting process means, and for transferring the same to said external apparatus; and said alarm processing apparatus having second alarm detection means for detecting externally issued alarm information, and for transferring the detected alarm information, holding time generation means for measuring a passage of a predetermined time using the alarm information transferred from said second alarm detection means as a trigger, and for outputting a holding pulse, second lighting process means for holding the alarm information by using the alarm information output from said second alarm detection means and the holding pulse output from said holding timing generation means, second display/transfer means for displaying the alarm information held in by said second lighting process means, and for transferring the same to said external apparatus, wherein said first lighting process means transfers the alarm information held in said second lighting process means to said first display/transfer means.

12. The synchronized alarm holding system as claimed in claim 11, wherein said first lighting process means does not process the alarm information transferred from said second lighting process means and transfers the same in an unmodified form to said first display/transfer means.

13. The synchronized alarm holding system as claimed in claim 11, wherein said second lighting process means has a register.

14. The synchronized alarm holding system as claimed in claim 11, wherein said holding timing generation means has a timer which holds the alarm information for a predetermined period of time.

15. The synchronized alarm holding system as claimed in claim 14, wherein said alarm synchronization means has registers totaling a number which corresponds to the frame used in alarm information extension.

16. The synchronized alarm holding system as claimed in claim 14, wherein said second lighting process means holds, in a holding mode, alarm information from said second alarm detection means using the holding pulse from said holding timing generation means.

17. A The synchronized alarm holding system, wherein synchronization means is provided in at least one of two apparatuses including an alarm detection apparatus for detecting an externally input alarm, and an alarm processing apparatus for displaying an alarm detection signal received from said alarm detection apparatus or another alarm detection apparatus, and for transferring said alarm detection signal to another apparatus, the synchronizing alarm holding system comprising:

said alarm detection apparatus having first alarm detection means for detecting alarm information externally issued when there is a failure, and for transferring detected alarm information to an external apparatus, alarm synchronization means for synchronizing said alarm information from said first alarm detection means with an external signal for holding said alarm information in frame pulse alignment so that said alarm information is held, first lighting process means for transferring alarm information synchronized by means of said alarm synchronization means, first display/transfer means for displaying the alarm information from said first lighting process means, and for transferring the same to said external apparatus, said alarm processing apparatus having second alarm detection means for detecting externally issued alarm information, and for transferring the detected alarm information, holding time generation means for measuring a passage of a predetermined time using the alarm information transferred from said second alarm detection means as a trigger, and for outputting a holding pulse, second lighting process means for holding the alarm information by using the alarm information output from said second alarm detection means and the holding pulse output from said holding timing generation means, second display/transfer means for displaying the alarm information held in by said second lighting process means, and for transferring the same to said external apparatus, and alarm transfer frame generation means for generating a frame pulse for alarm transfer, and for sending the same to said alarm synchronization means, wherein said alarm synchronization means extends said alarm information received from said first alarm detection means so as to fit said frame pulse received from said alarm transfer frame generation means, holds said alarm information transferred from said holding timing generation means and transfers said alarm information to said first lighting process means.

* * * * *